US009462637B2

(12) United States Patent
Kobayashi

(10) Patent No.: US 9,462,637 B2
(45) Date of Patent: Oct. 4, 2016

(54) HEATER DEVICE AND HEAT TREATMENT APPARATUS

(71) Applicant: Tokyo Electron Limited, Tokyo (JP)

(72) Inventor: Makoto Kobayashi, Iwate (JP)

(73) Assignee: Tokyo Electron Limited, Tokyo (JP)

( * ) Notice: Subject to any disclaimer, the term of this patent is extended or adjusted under 35 U.S.C. 154(b) by 191 days.

(21) Appl. No.: 14/219,394

(22) Filed: Mar. 19, 2014

(65) Prior Publication Data

US 2014/0284317 A1 Sep. 25, 2014

(30) Foreign Application Priority Data

Mar. 22, 2013 (JP) ..... 2013-060110

(51) Int. Cl.
*F27D 11/00* (2006.01)
*H05B 3/16* (2006.01)

(52) U.S. Cl.
CPC ..... *H05B 3/16* (2013.01)

(58) Field of Classification Search
CPC ..... H05B 3/06; H05B 3/16; H05B 6/108; H01L 21/67115; H01L 21/67109; H01L 21/32; C23C 16/46; C30B 31/12; C30B 25/10
See application file for complete search history.

(56) References Cited

FOREIGN PATENT DOCUMENTS

| | | | |
|---|---|---|---|
| JP | 03-115400 U | | 11/1991 |
| JP | 2002-162169 A | | 6/2002 |
| JP | 2008-300722 A | | 12/2008 |
| JP | 2011-258544 A | | 12/2011 |
| JP | 2013-16502 | * | 1/2013 |
| JP | 2013-016502 A | | 1/2013 |

* cited by examiner

*Primary Examiner* — Shawntina Fuqua
(74) *Attorney, Agent, or Firm* — Abelman, Frayne & Schwab

(57) ABSTRACT

Disclosed is a heater device. The heater device includes: a cylindrical insulating member; a heater element which is spirally wound plural times and disposed on an inner circumference side of the insulating member; and a supporting member having one or more first members disposed on inner circumference side of the heater element and extending in an axial direction of the insulating member, and a plurality of second members which extend from the first members to an outside of the insulating member in a radial direction and pass through gaps between turns of the heater element which are adjacent to each other in the axial direction of the insulating member such that end portions of the second members are formed to be embedded in the insulating member, in which the first members have expansion allowance portions which allow thermal expansion in the axial direction.

10 Claims, 5 Drawing Sheets

HEATER DEVICE AND HEAT TREATMENT APPARATUS

CROSS-REFERENCE TO RELATED APPLICATIONS

This application is based on and claims priority from Japanese Patent Application No. 2013-060110, filed on Mar. 22, 2013, with the Japan Patent Office, the disclosure of which is incorporated herein in its entirety by reference.

TECHNICAL FIELD

The present disclosure relates to a heater device and a heat treatment apparatus.

BACKGROUND

For example, in manufacturing a semiconductor device, processes such as, for example, a deposition process, an oxidation process, a diffusion process, an annealing process, and an etching process are performed on a semiconductor wafer which is an object to be processed. When these processes are performed, a heat treatment apparatus is used which includes a processing container configured to accommodate an object to be processed, and a heater device disposed on an outer circumference side of the processing container to surround the processing container.

The heater device includes, for example, a resistance heating element (heater element), and a cylindrical insulating member provided around the heater element. Specifically, the heater element is disposed on an inner circumference side of the insulating member by being wound, for example, in a spiral form through a supporting member. The supporting member supports slidably the heater element at a predetermined pitch.

In such a heater device, the heater element is supported slidably with a clearance in relation to the insulating member. However, the heater element is subject to creep strain by being repeatedly used at a high temperature, and its line length is elongated with elapse of time. When an excess length that occurs in the heater element due to the elongation of the line length of the heater element (hereinafter, referred to as "permanent elongation") is bent and deformed, axially adjacent turns of the heater element come in contact with each other, thereby causing a short-circuiting. Also, the heater element may be broken due to stress caused by deformation, such as, for example, thermal expansion and contraction, occurring according to heating and cooling of the heater element, as well as permanent elongation.

In order to solve these problems, Japanese Patent Laid-Open No. 2013-16502 discloses a heater device in which a heater element is allowed to move radially according to thermal expansion and contraction of the heater element but is suppressed from moving downward.

SUMMARY

The present disclosure provides a heater device that includes: a cylindrical insulating member; a heater element which is spirally wound plural times and disposed on an inner circumference side of the insulating member; and a supporting member having one or more first members disposed on inner circumference side of the heater element and extending in an axial direction of the insulating member, and a plurality of second members which extend from the first members to an outside of the insulating member in a radial direction and pass through gaps between turns of the heater element which are adjacent to each other in the axial direction of the insulating member such that end portions of the second members are formed to be embedded in the insulating member, in which the first members have expansion allowance portions which allow thermal expansion in the axial direction.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1:
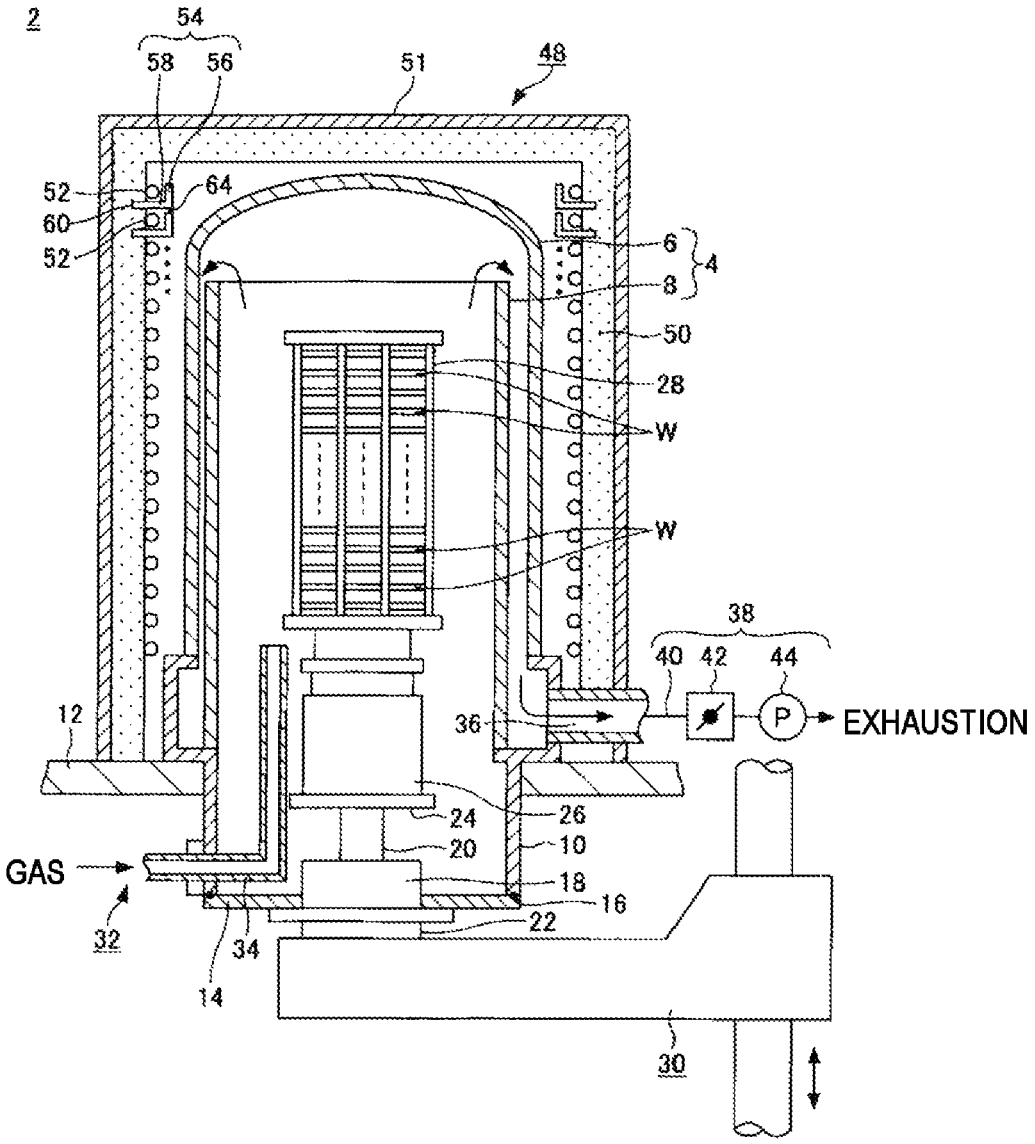
FIG. 1 is a view schematically illustrating a configuration of a heater device according to an exemplary embodiment of the present disclosure and a heat treatment apparatus provided with the heater device.

In the following detailed description, reference is made to the accompanying drawing, which form a part hereof. The illustrative embodiments described in the detailed description, drawing, and claims are not meant to be limiting. Other embodiments may be utilized, and other changes may be made without departing from the spirit or scope of the subject matter presented here.

A supporting member of the heater device disclosed in Japanese Patent Laid-Open No. 2013-16502 may be damaged or fall off from the insulating member because thermal expansion and contraction of the supporting member at the time of heating and cooling cannot be absorbed. This causes a problem in that the heater element falls off from the supporting member and turns of the heater element come in contact with each other, thereby causing a short-circuiting.

In consideration of the above described problems, the present disclosure provides a heater device in which a supporting member may be suppressed from being damaged.

A heater device according to an aspect of the present disclosure includes: a cylindrical insulating member; a heater element which is spirally wound plural times and disposed on an inner circumference side of the insulating member; and a supporting member having one or more first members disposed on inner circumference side of the heater element and extending in an axial direction of the insulating member, and a plurality of second members which extend from the first members to an outside of the insulating member in a radial direction and pass through gaps between turns of the heater element which are adjacent to each other in the axial direction of the insulating member such that end portions of the second members are formed to be embedded in the insulating member, in which the first members have expansion allowance portions which allow thermal expansion in the axial direction.

In the heater device as described above, each of the expansion allowance portions is formed to correspond to one of the second members.

In the heater device as described above, each of the expansion allowance portions is formed to correspond to two or more second members.

In the heater device as described above, the expansion allowance portions include gaps which separate the first members in the axial direction.

In the heater device as described above, each of the first members which are adjacent to each other through the gaps interposed therebetween has a shape which allows the first members to be engaged with each other.

In the heater device as described above, a shape of one side outer circumference of each of the first members which are adjacent to each other through the gaps interposed therebetween protrudes in an R shape toward the gaps side when viewed from a center of the insulating member.

In the heater device as described above, a width of the first members in a radial direction of the insulating member is longer than a length of thermal expansion and contraction of the heater element.

In the heater device as described above, the expansion allowance portions include heat shrinkable heat-resistant members.

In the heater device as described above, the heat shrinkable heat-resistant members include blanket-type heat-resistant members.

A heat treatment apparatus according to another aspect of the present disclosure includes: a processing container configured to accommodate objects to be processed; and the heater device which is disposed on an outer circumference of the processing container to surround the processing container.

The present disclosure may provide a heater device in which a supporting member may be suppressed from being damaged.

Hereinafter, exemplary embodiments of the present disclosure will be described with reference to accompanying drawings.

First Exemplary Embodiment (Heat Treatment Apparatus)

First, a basic configuration of a heater device according to an exemplary embodiment of the present disclosure, and a heat treatment apparatus provided with the heater device will be described.

FIG. 1 is a view schematically illustrating a configuration of a heater device according to an exemplary embodiment of the present disclosure and a heat treatment apparatus provided with the heater device, as an example. In the present specification, descriptions will be made on, for example, a heater device configured to accommodate a plurality of sheets of semiconductor wafers W as objects to be processed at once and to perform a heat treatment such as, for example, an oxidation process or a diffusion process, and a vertical heat treatment apparatus including the heater device. However, the present disclosure is not limited thereto, and may be employed in other various types of heater devices and heat treatment apparatuses.

As illustrated in FIG. 1, a vertical heat treatment apparatus 2 has a processing container 4 of which the longitudinal direction is the vertical direction. The processing container 4 is configured in a double-tube structure that has an outer tube 6 with a ceiling, and a cylindrical inner tube 8 which is concentrically disposed inside the outer tube 6.

The outer tube 6 and the inner tube 8 are made of a heat resistant material such as, for example, quartz. The bottom of the outer tube 6 and the inner tube 8 is held by a manifold 10 made of such as, for example, a stainless steel. The manifold 10 is fixed on a base plate 12. Alternatively, the processing container 4 may be formed of, for example, quartz, in its entirety without being provided with the manifold 10.

A disk-shaped cap portion 14 made of, for example, a stainless steel is attached to an opening of the bottom of the manifold 10 in a hermetical sealing manner through a sealing member 16 such as, for example, an O-ring. A rotation shaft 20 that is rotatable in a hermetically sealed state by, for example, a magnetic fluid seal 18 is inserted into the substantially central portion of the cap portion 14. A rotation mechanism 22 is connected to the lower end of the rotation shaft 20, and a table 24 made of, for example, stainless steel is fixed to the upper end of the rotation shaft 20.

A heat insulating tube 26 made of, for example, quartz is provided on the table 24. Also, a wafer boat 28 made of, for example, quartz is mounted as a support on the heat insulating tube 26.

In the wafer boat 28, for example, 50 to 150 sheets of semiconductor wafers W as objects to be processed are accommodated at a predetermined interval, for example, a pitch of about 10 mm. The wafer boat 28, the heat insulating tube 26, the table 24 and the cap portion 14 are integrally loaded to and unloaded from the inside of the processing container 4 by an elevating mechanism 30 which is, for example, a boat elevator.

A gas introducing unit 32 configured to introduce a processing gas into the processing container 4 is provided at a lower portion of the manifold 10. The gas introducing unit 32 has a gas nozzle 34 that is hermetically provided through the manifold 10.

Although one gas introducing unit 32 is provided in the configuration illustrated in FIG. 1, the present disclosure is not limited thereto. A heat treatment apparatus may have a plurality of gas introducing units 32 depending on, for example, the number of gas species to be used. The flow rate of a gas to be introduced from the gas nozzle 34 to the processing container 4 is controlled by a flow control mechanism (not illustrated).

A gas outlet 36 is formed at an upper portion of the manifold 10, and an exhaust system 38 is connected to the gas outlet 36. The exhaust system 38 includes an exhaust passage 40 connected to the gas outlet 36, and a pressure control valve 42 and a vacuum pump 44 which are sequentially connected in the middle of the exhaust passage 40. The atmosphere within the processing container 4 may be exhausted by the exhaust system 38 while being subjected to pressure control.

A heater device 48 that surrounds the processing container 4 to heat objects to be processed such as wafers W is provided over the outer circumference side of the processing container 4.

Hereinafter, a specific configuration example of the heater device 48 will be described with reference to drawings.

(Heater Device)

As illustrated in FIG. 1, the heater device 48 according to the present invention has a cylindrical insulating member 50 having a ceiling surface. The insulating member 50 is made of, for example, a mixture of relatively soft and amorphous silica and alumina each having a low thermal conductivity. Hereinafter, in the present specification, an "axial direction", a "circumferential direction" and a "radial direction" indicate the axial direction, the circumferential direction and the radial direction of the cylindrical insulating member 50, respectively.

As illustrated in FIG. 1, the insulating member 50 is disposed such that the inner circumference thereof is spaced apart from the outer surface of the processing container 4 by a predetermined distance. A protective cover 51 made of, for example, a stainless steel is attached to the outer circumference of the insulating member 50 to cover the entire outer peripheral surface of the insulating member 50.

Although not limited, the inner diameter of the insulating member 50 may be, for example, 550 mm, and the outer diameter of the insulating member 50 may range from, for example, 600 mm to 700 mm when, for example, wafers W of ϕ300 mm are processed as objects to be processed.

Figure 2:
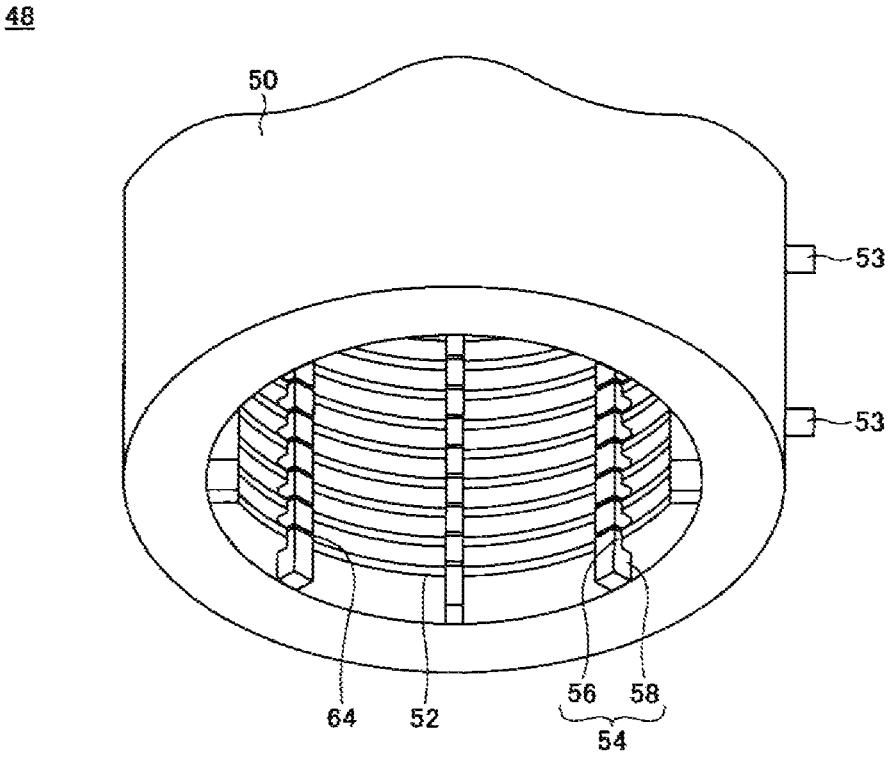
FIG. 2 is a schematic perspective view illustrating the heater device according to the exemplary embodiment of the present disclosure.

FIG. 2 is a schematic perspective view illustrating the heater device according to the exemplary embodiment of the present disclosure.

As illustrated in FIG. 2, on the inner circumference side of the insulating member 50, a heater element 52 is disposed by being spirally wound at a predetermined winding diameter at which the heater element 52 does not come in contact with the insulating member 50, and a predetermined arrangement pitch. Specifically, for example, the heater element 52 is supported at a predetermined arrangement pitch (for example, from about 3 mm to 10 mm) capable of securing a predetermined heat amount by supporting members 54, which will be described later, to be thermally expandable and contractible while being spaced apart from the inner wall surface of the insulating member 50 at a predetermined gap (for example, from about 3 mm to 10 mm). The diameter of a cross-section of the heater element generally ranges from about 1 mm to 10 mm.

As for the material of a heater element 52, all of conventionally known resistance heating elements may be used without being particularly limited. A specific example of the heater element 52 may be, for example, a heater element made of an iron-chromium-aluminum based (Fe—Cr—Al based) alloy. The heater element made of a Fe—Cr—Al based alloy may be generally a heater element having a composition of Cr (15 wt % to 30 wt %), Al (5 wt % to 30 wt %), and Fe (balance), and may further include the other additive elements.

Examples of other additive elements may include carbon (C), silicon (Si), manganese (Mn), phosphorous (P), sulfur (S), copper (Cu), nickel (Ni), cobalt (Co), molybdenum (Mo), titanium (Ti), zirconium (Zr), hafnium (Hf), scandium (Sc), vanadium (V), niobium (Nb), tantalum (Ta), tungsten (W), rare earth metals, oxygen (O), nitrogen (N), and boron (B). The contents of these additive elements vary according to, for example, a method of manufacturing the heater element or physical properties (e.g., creep resistance, oxidation resistance) required for the heater element, but is generally 1 wt % or less.

Figure 4:
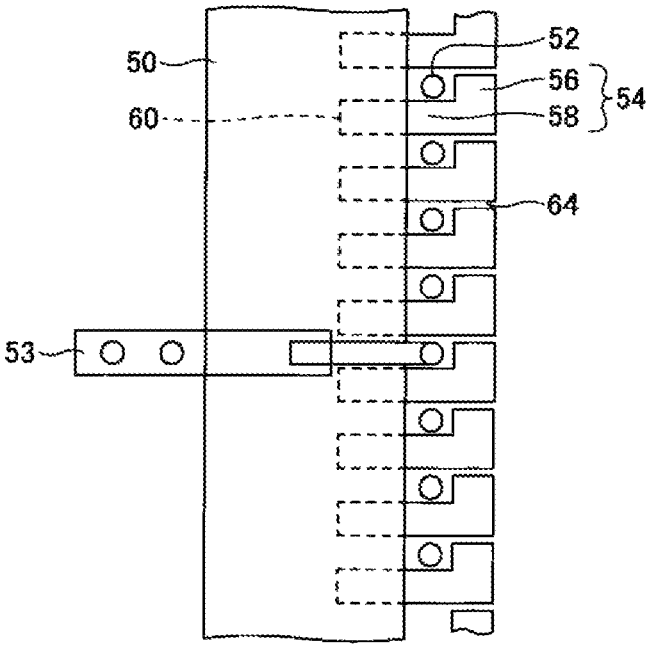
FIG. 4 is a partial vertical cross-sectional view of the heater device according to the exemplary embodiment of the present disclosure.

The heater element 52 may be divided into a plurality of zones (e.g., four zones) in the axial direction. In this case, at each end portion of the heater element 52 in each zone, as illustrated in FIG. 2 and FIG. 4 to be described later, a terminal plate 53 for electrode connection is provided to extend to the outside of the insulating member 50 through the insulating member 50. Since the heater element 52 is divided into a plurality of zones in the axial direction, the inside of the processing container 4 within the heater device 48 may divided into a plurality of zones in the axial direction of the insulating member 50 such that each of the zones may be subjected to a temperature control. That is, the heater device may suffer from a small temperature variation in the axial direction.

The terminal plate 53 to be used may be made of the same material as that of the heater element 52. The terminal plate 53 is formed in a plate shape with a predetermined cross-sectional area in terms of, for example, fusion prevention and heat dissipation amount.

The heater device 48 of the present disclosure has the supporting members 54 on the inner circumferential surface of the insulating member 50. The supporting members 54 extend in the axial direction of the insulating member 50 and are provided in the circumferential direction at predetermined intervals. The heater element 52 is slidably supported through the supporting members 54.

A specific exemplary embodiment of the supporting members 54 of the present disclosure will be described with reference to drawings.

(Supporting Member)

Figure 3:
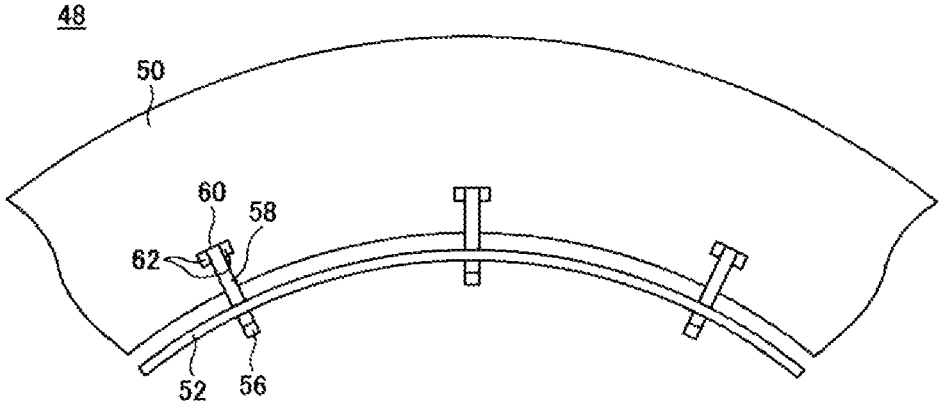
FIG. 3 is a partial horizontal cross-sectional view of the heater device according to the exemplary embodiment of the present disclosure.

FIG. 3 is a partial horizontal cross-sectional view of the heater device according to the exemplary embodiment of the present disclosure, and FIG. 4 is a partial vertical cross-sectional view of the heater device according to the exemplary embodiment of the present disclosure.

As illustrated in FIGS. 3 and 4 and the above-described FIG. 2, each supporting member 54 of the heater device 48 has a first member 56 and a second member 58.

The first member 56 is disposed on the inner circumference side of the heater element 52 and extends in the axial direction of the insulating member 50. The second member 58 extends from the first member 56 to the outside of the insulating member 50 in the radial direction and passes through a gap between turns of the heater element 52 which are adjacent to each other in the axial direction of the insulating member 50. An end portion 60 of the second member 58 is formed to be embedded in the insulating member 50. That is, the heater element 52 is slidably supported within a region surrounded by the first member 56, the second member 58 and the insulating member 50.

The first member 56 and the second member 58 of the supporting member 54 are made of a heat resistant and insulating material, such as, for example, ceramic.

As illustrated in FIG. 3, protrusions 62 may be provided at the end portion 60 of the second member 58 to suppress the supporting member 54 from coming out of the insulating member 50, for example, in a direction perpendicular to the second member 58.

Conventionally, there is known a heater device in which a rail member is provided in an insulating member, and a supporting member is disposed to be movable in the axial direction through the rail member. However, the rail member provided in the heater device requires a strength in its structure, and thus for the rail member, the similar material to the insulating member may not be used. Accordingly, the rail member is formed by using a material which is inferior to the insulating member in thermal insulation performance. The material having a high strength which is used for the rail member has a higher heat capacity and a higher thermal conductivity than the insulating member, thereby increasing a heat dissipation amount from the rail member. As a result, in the heater device having the rail member, there is a tendency that power consumption is increased.

In manufacturing the rail member, the number of components in the entire device is increased. This complicates the structure of the device, and increases a cost and weight of the device. Accordingly, the heater device having the rail member has a problem in that unevenness of heat dissipation is large, and thus uniform heating is difficult.

In the heater device 48 of the present disclosure, the end portion 60 of each second member 58 is formed to be directly embedded in the insulating member 50. Accordingly, unlike the heater device having the rail member, the heater device 48 of the present disclosure has small unevenness of heat dissipation to be capable of uniformly heating objects to be processed and requires low power consumption. Further, the heater device may be manufactured through a reduced number of processes and easily formed by, for example, suction molding. Thus, there is an advantage in that the manufacturing cost for the heater device 48 may be reduced as a whole.

The embedded length of the second members 58 with respect to the insulating member 50 is not particularly limited but may range, for example, from 15 mm to 20 mm.

In the present disclosure, each of the first members 56 has an expansion allowance portion which allows thermal expansion in the axial direction of the insulating member 50. As illustrated in FIG. 4, the expansion allowance portion in the present disclosure is a gap 64 which separates the first member 56 from a first member 56 adjacent thereto in the axial direction of the insulating member 50.

In a conventional heater device which does not have an expansion allowance portion such as, for example, the gaps 64, the supporting members 54 may be damaged because the supporting members 54 cannot absorb the thermal expansion thereof during heating up. The supporting members 54 and the insulating member 50 have highly different thermal expansion coefficients. Thus, when the supporting members 54 and the insulating member 50 are used repeatedly, especially, in high temperature heat treatments, the supporting members 54 may be easily damaged. When the supporting members 54 are damaged and the heater element 52 falls off from the damaged points, turns of the heater element 52 may come in contact with each other and cause a short-circuiting and a failure of the heater device.

However, in the present disclosure, the first members 56 have gaps 64 therebetween as expansion allowance portions to allow (absorb) the thermal expansion in the axial direction of the supporting members 54. Accordingly, even if the supporting members 54 are thermally expanded in the axial direction of the insulating member 50, the thermal expansion may be allowed by the gaps 64. Accordingly, the heater device 48 of the present disclosure may be stably driven for a long term without causing a damage to the supporting members 54.

Figure 5C:
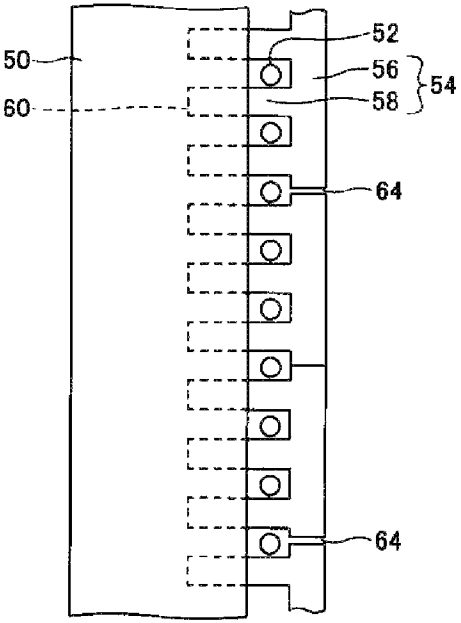
FIGS. 5A to 5C are partial vertical cross-sectional views of other examples of the heater device according to the present disclosure.
Figure 5B:
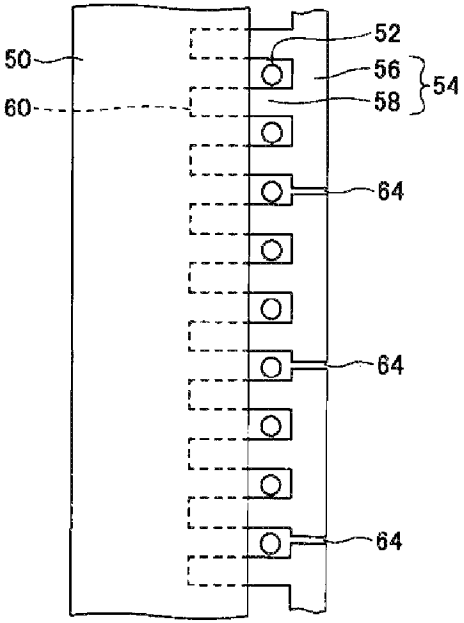
Figure 5A:
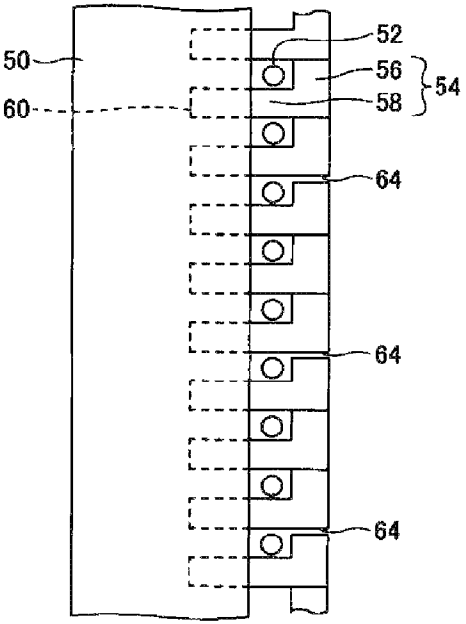

In the example illustrated in FIG. 4, each gap 64 is formed to correspond to one second member 58. That is, in the illustrated example, each gap 64 is formed in each turn of the heater element 52, but the present disclosure is not limited thereto. FIGS. 5A to 5C are partial vertical cross-sectional views of other examples of the heater device according to the present disclosure.

The example of FIG. 5A is different from the example illustrated in FIG. 4 in that each gap 64 is formed to correspond to a plurality of second members 58. That is, in the example of FIG. 5A, each first member 56 is formed to correspond to each second member 58, but some of adjacent first members 56 are in contact with each other without the gaps 64 interposed therebetween, and each gap 64 is formed for every three first members 56. In the illustrated example of FIG. 5A, each gap 64 is formed for every three second members 58, but each gap 64 may be formed for every two second members 58 or four or more second members 58.

In the example of FIG. 5B, as in the example of FIG. 5A, each gap 64 is formed to correspond to a plurality of second members 58. However, in the example of FIG. 5A, each first member 56 is formed to correspond to each second member 58, while in the example of FIG. 5B, a plurality of first members 56 are integrally formed as one piece to correspond to a plurality of second members 58. That is, in the example of FIG. 5B, each supporting member 54 has a comb-shape cross section in the axial direction of the insulating member 50. The comb-shaped supporting members 54 are disposed at a predetermined pitch in the axial direction of the insulating member 50 while leaving gaps 64 between the adjacent supporting members 54.

In the example illustrated in FIG. 5C, in another structure, a supporting member 54 may have a comb-shape like the example of FIG. 5B in which each first member 56 is formed to correspond to a plurality of second members 58, and some of the adjacent first members 56 may be in contact with each other without gaps 64 interposed therebetween. More specifically, in FIG. 5C, each gap 64 is formed for every two first members 56. In the illustrated example of FIG. 5C, each gap 64 is formed for every two first members 56, but each gap 64 may be formed for every three or more first members 56.

The width of the gaps 64 is not particularly limited, but preferably is smaller than the diameter of a cross section of the heater element 52. This suppresses the heater element 52 from falling off from the supporting members 54 through the gaps 64.

The width of the first members 56 in the radial direction of the insulating member 50 is preferably set to be longer than the thermal expansion/contraction length of the heater element 52. Accordingly, if the first members 56 are moved in the radial direction of the insulating member 50, the adjacent first members 56 have an overlapping region when viewed in the axial direction of the insulating member 50. Accordingly, the heater element 52 may be suppressed from falling off from the supporting members 54.

The supporting members 54 are disposed on the inner circumferential surface of the insulating member 50 in the circumferential direction at predetermined intervals, for example, at 30°.

As described above, the heater element 52 is slidably supported through the supporting members 54. At the time of manufacturing, the distance (also referred to as a "clearance") between the insulating member 50 and the outer circumference of the heater element 52 is set to be about a thermal expansion amount at a use temperature in consideration of the size or use temperature of the heater device 48, and specifically, in a range of from about 3 mm to 10 mm in consideration of the line length extension of the heater element 52 together with the size or use temperature in the case of longer term use. By the clearance provided between the insulating member 50 and the outer circumference of the heater element 52, displacement of the heater element 52 by thermal expansion and contraction according to heating and cooling is allowed. As a result, the heater element 52 is slidably supported through the supporting members 54.

It is desirable that the first members 56 which are adjacent to each other through gaps 64 interposed therebetween have a shape which allows them to be engaged with each other.

Figure 6A:
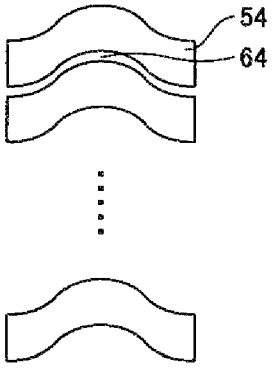
FIGS. 6A to 6C are schematic views of first members when viewed from the center of an insulating member according to the present disclosure.
Figure 6B:
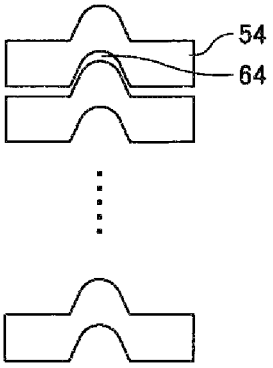
Figure 6C:
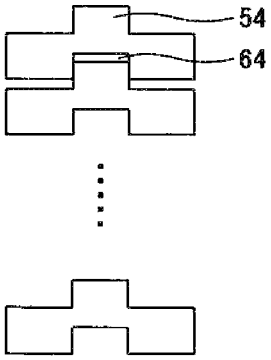

FIGS. 6A to 6C are examples of an external shape of the first member 56 when viewed from the center of the insulating member 50 of the present disclosure.

As illustrated in FIGS. 6A to 6C, the first members 56 which are adjacent to each other through gaps 64 interposed therebetween may be formed in a shape which allows them to be engaged with each other. This further reduces the possibility that a heater element 52 may fall off from supporting members 54 through the gaps 64.

Here, it is desirable that the shape of one side outer circumference of each of the first members 56 which are adjacent to each other through gaps 64 interposed therebetween protrudes in an R shape toward the gaps 64 side, as illustrated in FIGS. 6A and 6B when viewed from the center of the insulating member 50. Accordingly, even if the first members 56 which are adjacent to each other through the gaps 64 interposed therebetween come in contact with each other, a frictional resistance at the time of contact may be reduced. This further reduces the possibility that the supporting members 54 fall off.

It is desirable that surfaces of the first member 56 and the second member 58 which come in contact with the heater element 52 are formed in curved shapes so that a frictional resistance may be reduced when the heater element 52 is slidably moved by thermal expansion and contraction.

In the heater device 48 as configured above and the heat treatment apparatus 2 having the heater device 48, the first members 56 have the gaps 64 which allow thermal expansion in the axial direction of the insulating member 50. Accordingly, the supporting members 54 may be suppressed from being damaged, which may be caused unless the thermal expansion and contraction is allowed. That is, it is possible to provide a heater device and a heat treatment apparatus which are less likely to suffer from damage to the supporting members 54 and thus may be stably driven for a long term.

Secondary Exemplary Embodiment

Figure 7:
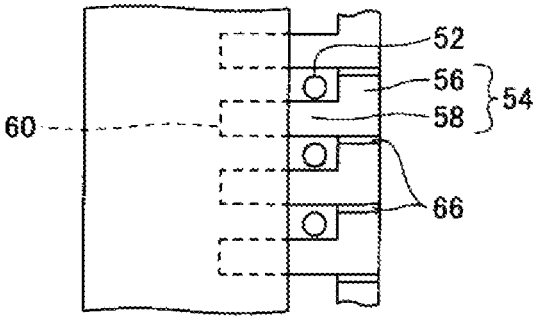
FIG. 7 is a partial vertical cross-sectional view of a heater device according to another exemplary embodiment of the present disclosure.

FIG. 7 is a partial vertical cross-sectional view of a heater device according to another exemplary embodiment of the present disclosure. A heater device 48 of a second exemplary embodiment is different from that of the first exemplary embodiment in that an expansion allowance portion in a first supporting member 56 is a heat-shrinkable heat-resistant member 66.

Since the heat-shrinkable heat-resistant members 66 are disposed, in the same manner as in the heater device of the first exemplary embodiment, the first members 56 may be allowed to be thermally expanded in the axial direction of the insulating member 50. Accordingly, it is possible to provide a heater device and a heat treatment apparatus which are less likely to suffer from damage to the supporting members 54 and thus may be stably driven for a long term.

Each heat-shrinkable heat-resistant member 66 may be, for example, a blanket-type heat-resistant member, and specifically, for example, ceramic fibers such as alumina fibers or silica fibers may be used.

As in the first exemplary embodiment, each heat-resistant member 66 may be provided to correspond to one second member 58, and may be provided to correspond to a plurality of second members 58.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. A heater device comprising:

a cylindrical insulating member;

a heater element which is spirally wound plural times and disposed on an inner circumference side of the insulating member; and a supporting member having one or more first members disposed on inner circumference side of the heater element and extending in an axial direction of the insulating member, and a plurality of second members which extend from the first members to an outside of the insulating member in a radial direction and pass through gaps between turns of the heater element which are adjacent to each other in the axial direction of the insulating member such that end portions of the second members are formed to be embedded in the insulating member, wherein the first members have expansion allowance portions which allow thermal expansion in the axial direction and include gaps interposed between the first members adjacent to each other so as to separate each of the first members in the axial direction of the insulating member.

2. The heater device of claim 1, wherein each of the expansion allowance portions is formed to correspond to one of the second members.

3. The heater device of claim 1, wherein each of the expansion allowance portions is formed to correspond to two or more second members.

4. The heater device of claim 1, wherein each of the first members which are adjacent to each other through the gaps interposed therebetween has a shape which allows the first members to be engaged with each other.

5. The heater device of claim 4, wherein a shape of one side outer circumference of each of the first members which are adjacent to each other through the gaps interposed therebetween protrudes in an R shape toward the gaps side when viewed from a center of the insulating member.

6. The heater device of claim 1, wherein a width of the first members in a radial direction of the insulating member is longer than a length of thermal expansion and contraction of the heater element.

7. A heat treatment apparatus comprising a processing container configured to accommodate objects to be processed; and the heater device of claim 1 which is disposed on an outer circumference of the processing container to surround the processing container.

8. A heater device comprising:

a cylindrical insulating member;

a heater element which is spirally wound plural times and disposed on an inner circumference side of the insulating member; and a supporting member having one or more first members disposed on inner circumference side of the heater element and extending in an axial direction of the insulating member, and a plurality of second members which extend from the first members to an outside of the insulating member in a radial direction and pass through gaps between turns of the heater element which are adjacent to each other in the axial direction of the insulating member such that end portions of the second members are formed to be embedded in the insulating member, wherein the first members have expansion allowance portions which allow thermal expansion in the axial direction and include heat shrinkable heat-resistant members interposed between the first members adjacent to each other.

9. The heater device of claim 8, wherein the heat shrinkable heat-resistant members include blanket-type heat-resistant members.

10. A heat treatment apparatus comprising:

a processing container configured to accommodate objects to be processed; and the heater device of claim 8 disposed on an outer circumference of the processing container to surround the processing container.

* * * * *